US006481391B2

(12) United States Patent
Nabeya et al.

(10) Patent No.: US 6,481,391 B2
(45) Date of Patent: Nov. 19, 2002

(54) MAGNETIC DRIVING PUMP OF VEHICLE INTERNAL COMBUSTION ENGINE

(75) Inventors: Shin Nabeya, Saitama (JP); Masatoshi Fukamachi, Saitama (JP); Yutaka Miyake, Saitama (JP); Osamu Sato, Gunma-Ken (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/987,184

(22) Filed: Nov. 13, 2001

(65) Prior Publication Data

US 2002/0056433 A1 May 16, 2002

(30) Foreign Application Priority Data

Nov. 13, 2000 (JP) ..... 2000-344700

(51) Int. Cl.[7] ..... F01P 5/10
(52) U.S. Cl. ..... 123/41.44; 123/41.47
(58) Field of Search ..... 123/41.44, 41.47

(56) References Cited

U.S. PATENT DOCUMENTS 4,662,320 A * 5/1987 Moriya ..... 123/41.44

FOREIGN PATENT DOCUMENTS

| | | | |
|---|---|---|---|
| JP | A64-66490 | | 3/1989 |
| JP | 10-89069 | * | 4/1998 |

* cited by examiner

*Primary Examiner*—Noah P. Kamen
(74) *Attorney, Agent, or Firm*—Birch, Stewart, Kolasch & Birch, LLP

(57) ABSTRACT

To reliably prevent the occurrence of a pull out phenomenon in a magnetic driving pump of a vehicle internal combustion engine where permanent magnets, magnetized to have alternate N poles and S poles around an axis of a drive shaft and a driven shaft, are respectively fixed to the drive shaft and the driven shaft. The drive shaft is interlocked with a crankshaft and the driven shaft is coaxially mounted with the drive shaft. Furthermore, the permanent magnets are magnetized to have alternate N poles and S poles 90 degrees or 180 degrees in phase in a peripheral direction.

12 Claims, 3 Drawing Sheets

MAGNETIC DRIVING PUMP OF VEHICLE INTERNAL COMBUSTION ENGINE

CROSS-REFERENCE TO RELATED APPLICATIONS

The present application claims priority to Japanese Application No.: 2000-344700, filed Nov. 13, 2000, the contents of which are hereby incorporated by reference.

BACKGROUND OF THE INVENTION

1. Field of the Invention

The present invention relates to a magnetic driving pump for a vehicle internal combustion engine. In particular, the present invention is directed to a magnetic driving pump having permanent magnets, which are magnetized to have alternate N poles and S poles around an axial line of a drive shaft and a driven shaft. The permanent magnets are respectively fixed to the drive shaft, which is interlocked with a crankshaft of the engine and the driven shaft, which is coaxially provided with the drive shaft.

2. Description of Background Art

Conventionally, a magnetic driving pump, in which mutually magnetized permanent magnets are respectively fixed to a drive shaft driven by an electric motor and a driven shaft coaxially provided with the drive shaft, is known from, e.g., Japanese Published Unexamined Patent Application No. Sho 64-66490.

However, in this magnetic driving pump, a phase difference between magnetic poles of the permanent magnet on the drive shaft side and the permanent magnet on the driven shaft side increases by a resonance phenomenon due to variations in revolution of the drive shaft side and variations in revolution of the driven shaft side. Accordingly, power is transmitted from the drive shaft side by the magnetic force. Furthermore, the phase difference may exceed a relative angle range of magnetic poles for power transmission between the drive shaft and the driven shaft, and a power-transmittable torque between the drive shaft and the driven shaft may be degraded by degradation of the relative magnetic force. Accordingly, a step out (pull out) phenomenon, wherein the driven shaft side cannot rotate in correspondence with the drive shaft side may occur.

In the magnetic driving pump disclosed in the above Japanese Published Unexamined Patent Application No. Sho 64-66490, an inertial moment of the drive shaft side is set to a value 4 or more times greater than that on the driven shaft side. Accordingly, variations in the revolution on the drive shaft side are suppressed to attain mild acceleration and prevent the occurrence of the pull out phenomenon on the driven shaft side.

However, in a magnetic driving pump, wherein a drive shaft is interlocked with a crankshaft of an internal combustion engine having a wide revolution area, especially an internal combustion engine mounted on a vehicle, the occurrence of the pull out phenomenon on the driven shaft side cannot be completely prevented only by a change in inertial mass as described above.

SUMMARY OF THE INVENTION

The present invention has been made in view of the above situation, and has as its object to provide a magnetic driving pump for a vehicle internal combustion engine to reliably prevent the occurrence of the pull out phenomenon.

To attain the foregoing object, according to a first aspect of the present invention, a magnetic driving pump for a vehicle internal combustion engine includes permanent magnets, which are magnetized to have alternate N poles and S poles around an axial line of a drive shaft and a driven shaft. The permanent magnets are respectively fixed to the drive shaft, which is interlocked with a crankshaft of the engine and the driven shaft, which is coaxially provided with the drive shaft of the engine. The permanent magnets are magnetized to have alternate N poles and S poles 90 degrees or 180 degrees in phase in a peripheral direction, and are respectively fixed to the drive shaft and the driven shaft.

According to this construction, 4-pole or 2-pole permanent magnets having different magnetic poles adjacent in a peripheral direction are respectively fixed to the drive shaft and the driven shaft. The driving force can be transmitted between the 4-pole or 2-pole permanent magnets within a range of 90 degrees or 180 degrees of mutual phase difference. As it is apparent from the experimental results shown in FIG. 3, the phase difference between the driven shaft and the drive shaft in use of 4-pole permanent magnets is 60 degrees at the maximum in an anteroposterior direction on one side. Furthermore, there is an allowable phase difference of 30 degrees (=90−60) before the occurrence of the pull out phenomenon. Since the allowable phase difference is sufficient when considering changes in magnetic force due to temperature changes, a relative dimensional error between the permanent magnets upon assembly of the pump, a variation in inertial mass on the driven shaft side, and the width of variations in revolution on the internal combustion engine side, the occurrence of the pull out phenomenon can be reliably prevented. Furthermore, during use of the 2-pole permanent magnets, the pull out phenomenon does not occur before the phase difference on the driving shaft side with respect to the driven shaft side becomes 180 degrees on one side. Since there is a sufficient allowable phase difference, the occurrence of the pull out phenomenon can be reliably prevented as in the case of 4-pole permanent magnets. On the other hand, during use of 6 or more pole permanent magnets, according to the experimental results shown in FIG. 3, there is merely an allowable phase difference of 15 degrees or less on one side before the occurrence of the pull out phenomenon. The allowable phase difference cannot be sufficient to prevent the occurrence of the pull out phenomenon.

According to a second aspect of the present invention, in addition to the construction of the above-described first aspect of the present invention, one ring shaped permanent magnet is provided in the inner perimeter of a cup-shaped rotary member fixed to the drive shaft. Another ring shaped permanent magnets is fixed to the driven shaft in the portion coaxially covered with the rotary member. According to this construction, in comparison with the case where a pair of permanent magnets are provided at an interval in an axial direction, an area in which the respective magnetic poles of one permanent magnet face the other permanent magnet side can be increased, to increase transmission torque by the magnetic force. Furthermore, an impeller or the like provided on the driven shaft side can be provided closer to the rotary member on the drive shaft side in the axial direction. Accordingly, the inertial mass on the driven shaft side can be set to a small value, to increase the response of the driven shaft side and more reliably prevent the occurrence of the pull out phenomenon.

According to a third aspect of the present invention, in addition to the construction of the above-described first and second aspects of the present invention, the drive shaft is a camshaft interlocked and connected with the crankshaft at a deceleration ratio of 1/2. According to this construction, since the number of revolutions of the camshaft is 1/2 of that of the crankshaft, variations in revolution of the drive shaft can be suppressed as much as possible, and the occurrence of the pull out phenomenon can be reduced.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Hereinbelow, a working example of the present invention will be described in accordance with an embodiment of the present invention with reference to the accompanying drawings.

Figure 1:
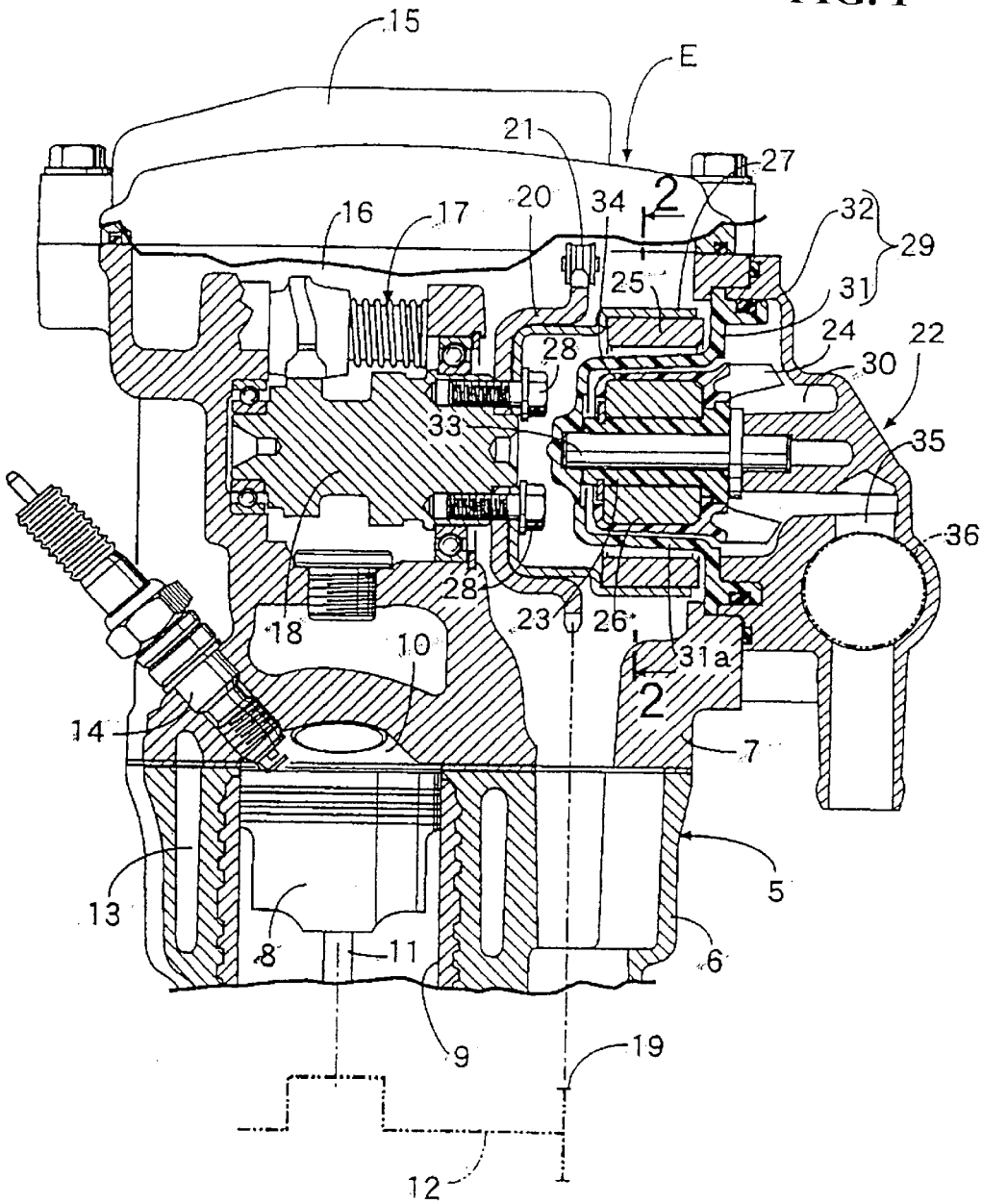
FIG. 1 is a vertical cross-sectional view showing a part of the internal combustion engine according to the present invention.
Figure 2:
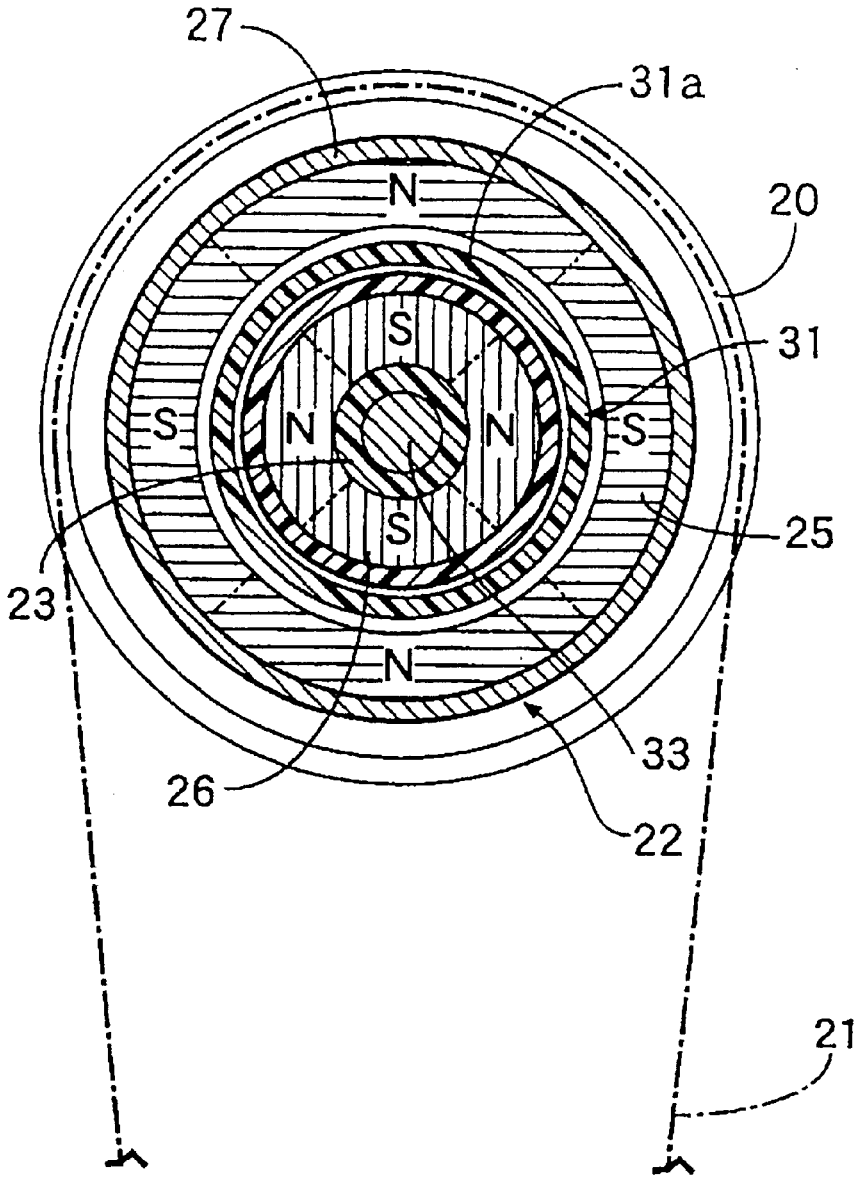
FIG. 2 is a cross-sectional view along the line 2—2 in FIG. 1.
Figure 3:
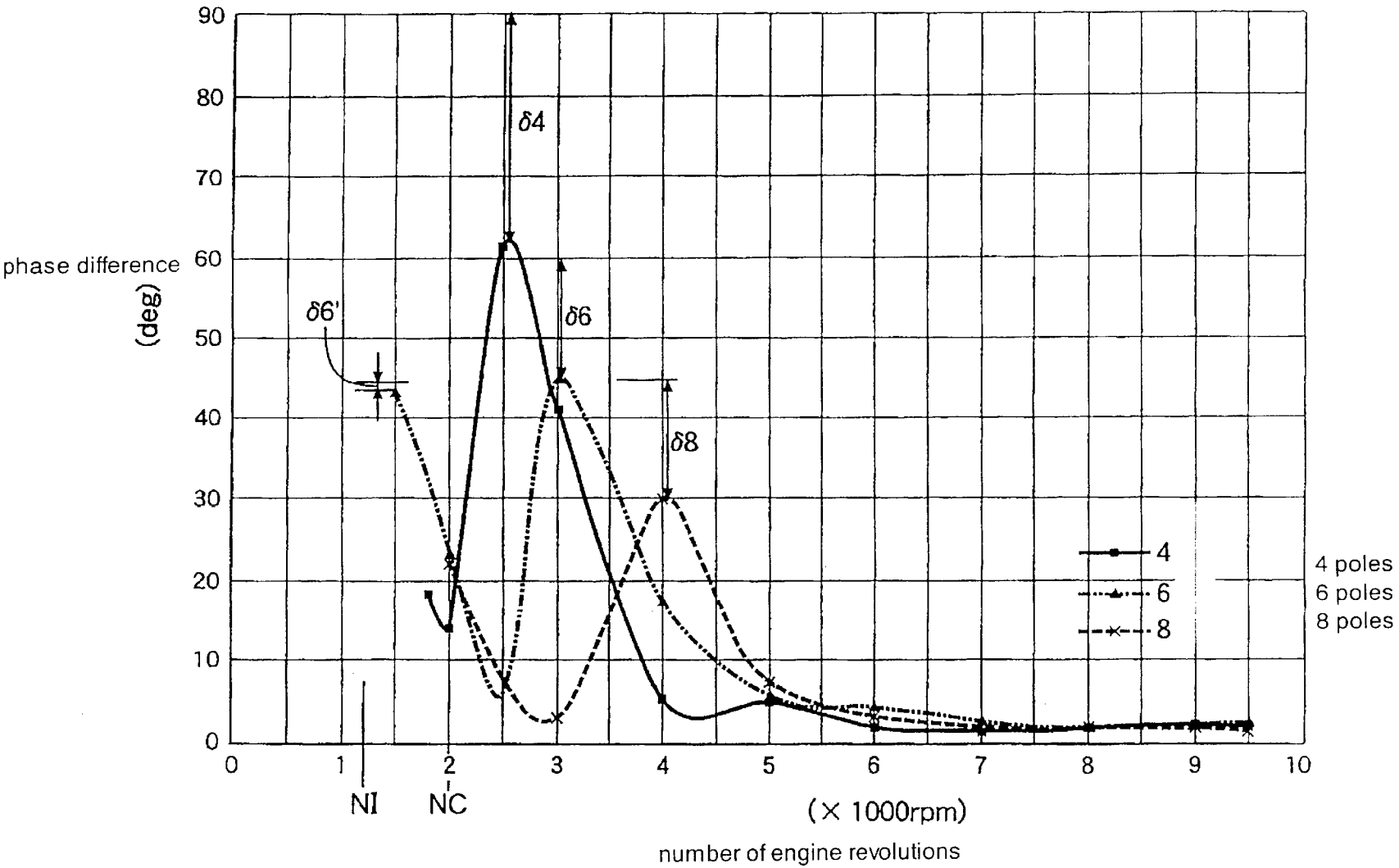
FIG. 3 is a diagram showing the experimental results of a measurement of variations in revolution on the driving side with respect to the number of engine revolutions for permanent magnets having a different number of poles.

FIG. 1 is a vertical cross-sectional view showing a part of an internal combustion engine according to the present invention; FIG. 2, a cross-sectional view along line 2—2 in FIG. 1; and FIG. 3 is a diagram showing experimental results of a measurement of variations in revolution on the driving side with respect to the number of engine revolutions for permanent magnets having a different number of poles.

First, in FIG. 1, an engine main body 5 of a water-cooled internal combustion engine E mounted on, e.g. a motorcycle, includes a cylinder block 6 having a cylinder bore 9 slidably engaged with a piston 8. A cylinder head 7 is connected to the cylinder block 6, forming a combustion chamber 10 between a top of the piston 8 and the cylinder head. A crank case (not shown) is connected to the cylinder block 6 to rotatably support the crankshaft 12, which is connected to the piston 8 via a connecting rod 11. The cylinder block 6 and the cylinder head 7 are provided with a water jacket 13 to circulate cooling water. An ignition plug 14, facing the combustion chamber 10, is attached to the cylinder head 7.

A valve chamber 16 is formed between the cylinder head 7 and a head cover 15 connected to the cylinder head 7. The valve chamber 16 includes an intake valve (not shown) to control supply of air-fuel mixture to the combustion chamber 10 and a valve mechanism 17 to drive an exhaust valve (not shown) to control exhaustion of burned gas from the combustion chamber 10. A camshaft 18 forming a part of the valve mechanism 17 is rotatably supported on the cylinder head 7 on an axial line parallel to the crankshaft 12.

A drive sprocket 19 is fixed to the crankshaft 12. A driven sprocket 20 is fixed to the camshaft 18. An endless chain 21 is secured around the driven sprocket 20 and the drive sprocket 19. With this arrangement, the number of revolutions of the crankshaft 12 is reduced at a deceleration ratio of 1/2 and is transmitted to the camshaft 18.

The camshaft 18 also functions as a drive shaft of a water pump 22 as a magnetic driving pump according to the present invention. In the water pump 22, permanent magnets 25 and 26 are magnetized to have alternate N poles and S poles around an axial line of the camshaft 18 and a driven shaft 23. The permanent magnets 25 and 26 are respectively fixed to the camshaft 18 as the drive shaft and the driven shaft 23 which is coaxially provided with the camshaft 18 and provided with an impeller 24.

Also referring to FIG. 2, a cup-shaped rotary member 27 is pressed from, e.g., a thin stainless steel plate. The cup-shaped rotary member 27 is coaxially fastened, with the driven sprocket 20, to the camshaft 18 by plurality of bolts 28. The ring-shaped permanent magnet 25 is fixed to an inner perimeter of the rotary member 27.

The impeller 24 is accommodated in an eddy chamber 30 formed in a pump housing 29. The pump housing 29 includes a housing main body 31 with an open end opposite to the camshaft 18, and a pump cover 32 which closes the open end of the housing main body 31. The eddy chamber 30 is formed between the cover and the housing main body 31. The pump housing 29 is fastened to the cylinder head 7 with a part of the housing main body 31 inserted into the cylinder head 7.

The housing main body 31 formed of a non-magnetic material has a bottomed cylindrical part 31*a* with a closed camshaft 18 side. The bottomed cylindrical part 31*a* is coaxially inserted into the permanent magnet 25 fixed to the inner perimeter of the rotary member 27, which rotates with the camshaft 18.

Both ends of a support shaft 33, which is coaxial with the camshaft 18, are fixed to the closed end of the bottomed cylindrical part 31*a* and the pump cover 32 in the housing main body 31. A cylindrical-shaped driven shaft 23 formed of, e.g., synthetic resin, coaxially surrounds the support shaft 33. The cylindrical-shaped driven shaft 23 is rotatably supported by the support shaft 33. Furthermore, the ring-shaped permanent magnet 26 is fixed to an outer perimeter of the driven shaft 23.

The permanent magnet 26 is covered with a coating 34 of synthetic resin. The impeller 24 is integrally formed with the coating 34. Specifically, the impeller 24 is fixed to the driven shaft 23 via the coating 34 and the permanent magnet 26. In a portion coaxially covered with the rotary member 27, where the ring-shaped permanent magnet 25 is fixed to the inner perimeter, the ring-shaped permanent magnet 26 is fixed to the driven shaft 23, with the bottomed cylindrical part 31*a* and the coating 34 positioned between the magnet 26 and the permanent magnet 25.

An intake port 35 in communication with a central portion of the eddy chamber 30 is provided in a central portion of the pump cover 32. Cooling water from the intake port 35 flows into the eddy chamber 30 and is pressed by rotation of the impeller 24. The cooling water discharged from the water pump 22 is supplied to the water jacket 13 of the engine main body 5 shown in FIG. 1. The water jacket 13 is connected to a radiator (not shown).

Furthermore, the pump cover 32 includes a thermostat 36. The thermostat 36 operates to select connection or disconnection of the intake port 35 with an exit of the radiator in correspondence with the temperature of the cooling water. Specifically, when the cooling water temperature is low, i.e., when the internal combustion engine E is cool, the cooling water from the water jacket 13 is restored to the water jacket 13 via the thermostat 36 and the water pump 22. However, when the cooling water temperature is high, i.e,. in a state where the internal combustion engine E has been warmed up, the cooling water is restored to the water jacket 13 via the radiator, the thermostat 36 and the water pump 22, thus the cooling water is cooled by the radiator.

In the magnetic driving type water pump 22, resonance may occur between variations in revolution of the camshaft 18 due to variations in revolution of the engine E and variations in revolution of the driven shaft 23, to which the driving force is transmitted by the magnetic force from the camshaft 18. Specifically, as the driving side permanent magnet 25 rotates around the axial line, a force to restore the phase difference between the magnetic poles of the permanent magnets 25 and 26 to "0" acts between the permanent magnets 25 and 26 on the driving side and the driven side. The restoration force changes to a nonlinear force in correspondence with the phase difference. If the restoration force is replaced by a spring force, a spring constant is reduced in accordance with an increment of amplitude, and a natural oscillation is moved to a lower value. The movement of the natural oscillation causes resonance of the driven side with the driving side. This resonance may increase the phase difference between the driving side and the driven side even with a statically sufficient transmission torque, to cause the pull out phenomenon.

Accordingly, the present inventors performed an experiment by using actual startup of the internal combustion engine E mounted on a motorcycle. Specifically, the present inventors checked variations in revolution of the driven side with respect to the driving side when the number of magnetic poles in the permanent magnet 25 fixed to the inner perimeter of the rotary member 27 and the permanent magnet 26 fixed to the outer perimeter of the driven shaft 23 are changed to 4 poles, 6 poles and 8 poles. In this case, the permanent magnet 25 is on the driving side and the permanent magnet 26 is on the driven side. Experimental results were then obtained as shown in FIG. 3.

In FIG. 3, the vertical axis indicates the phase difference on the driven side with respect to the driving side. The phase difference is represented by amplitude on the driven side with respect to the driving side in a full load state when the throttle of the internal combustion engine E is fully-opened.

Since the water pump 22 substantially functions when the number of revolutions of the internal combustion engine E is equal to or greater than the number of idle revolutions NI (e.g. 1200 rpm), the amplitude may be determined by the number of engine revolutions equal to or greater than the idle revolutions NI. Furthermore, in the case of a motorcycle having a centrifugal clutch between the internal combustion engine E and the driving wheel to establish power transmission upon startup, the amplitude may be determined by the number of engine revolutions equal to or greater than the number of clutch-connected revolutions NC (e.g. 2000 rpm) where the clutch is in a connected state.

If the phase difference is examined between the driving side and the driven side by using the permanent magnets 25 and 26 with a different number of poles under these conditions, when the permanent magnets 25 and 26 are magnetized to have 8 poles, i.e,. respectively, 4 alternate N poles and S poles 45 degrees in phase, a maximum phase difference of about 30 degrees occurs on one side when the number of engine revolutions is equal to or greater than the number of idle revolutions NI at about 4000 rpm. The allowable phase difference δ8 with respect to the phase difference of 45 degrees to cause the pull out phenomenon is about 15 degrees.

When the permanent magnets 25 and 26 are magnetized to have 6 poles, i.e., respectively, 3 alternate N poles and S poles 60 degrees in phase, a phase difference of about 45 degrees occurs on one side when the number of engine revolutions is equal to or greater than the number of clutch-connected revolutions NC at about 3000 rpm. The allowable phase difference δ6 with respect to the phase difference of 60 degrees to cause the pull out phenomenon is about 15 degrees. Furthermore, a maximum phase difference of about 42.5 degrees occurs on one side when the number of engine revolutions is equal to or greater than the number of idle revolutions NI at about 1500 rpm. The allowable phase difference δ6' with respect to the phase difference of 45 degrees to cause the pull out phenomenon is about 2.5 degrees.

When the permanent magnets 25 and 26 are magnetized to have 4 poles, i.e., respectively, 2 alternate N poles and S poles 90 degrees in phase, a phase difference of about 60 degrees occurs on one side when the number of engine revolutions is equal to or greater than the number of idle revolutions NI at about 2500 rpm. The allowable phase difference δ4 with respect to the phase difference of 90 degrees to cause the pull out phenomenon is about 60 degrees.

According to these experimental results, in the water pump 22 using the 4-pole permanent magnets 25 and 26, the maximum phase difference is 60 degrees on the driving side to the driven shaft 23, i.e., the rotary member 27 and the camshaft 18. The allowable phase difference δ4 is 30 degrees (=90−60) before the occurrence of the pull out phenomenon. Since the allowable phase difference δ4 is sufficient even when considering variations in magnetic force due to temperature changes, the relative dimensional error between the permanent magnets 25 and 26 upon assembly of the water pump 22, the variations in the inertial mass on the driven shaft 23 side, and the amplitude of variations in revolution on the internal combustion engine E side, the occurrence of the pull out phenomenon can be reliably prevented.

In the water pump 22 using the 2-pole permanent magnets 25 and 26, the pull out phenomenon does not occur before the phase difference on the driving side with respect to the driven side becomes 180 degrees. Since the allowable phase difference is sufficient, the occurrence of the pull out phenomenon can be reliably prevented as in the case of the use of 4-pole permanent magnets.

On the other hand, when using 6 or more pole permanent magnets 25 and 26, the allowable phase difference before the occurrence of the pull out phenomenon is merely δ6, δ8, and δ6' of 15 degrees or less on one side, which cannot be a sufficient phase difference to prevent the occurrence of the pull out phenomenon.

Accordingly, a water pump 22, which enables sufficient torque transmission between the driving and driven sides and reliably prevents the occurrence of the pull out phenomenon, can be obtained by using the 4-pole or 2-pole permanent magnets 25 and 26. The ring-shaped permanent magnet 25 is fixed to the inner perimeter of the cup-shaped rotary member 27, which is fixed to the camshaft 18. The other ring-shaped permanent magnet 26 is fixed to the driven shaft 23 with a portion coaxially covered with the rotary member 27. Accordingly, in comparison with the arrangement where the pair of permanent magnets is provided in an axial direction at an interval, the transmission torque by the magnetic force can be increased by increasing the area where one of the permanent magnets 25 and 26 faces the other. Furthermore, the impeller 24 on the driven shaft 23 side is provided closer to the rotary member 27 in the axial direction, and the inertial mass on the driven shaft 23 side is set to a small value. Accordingly, the response of the driven shaft 23 side can be increased, and the occurrence of the pull out phenomenon can be reliably prevented.

Furthermore, since the permanent magnet 25 rotates with the camshaft 18, is interlocked and connected with the crankshaft 12 at a deceleration ratio of 1/2, and the number of revolutions of the camshaft 18 is 1/2 that of the crankshaft 12, the variations in revolution of the camshaft 18 can be suppressed as much as possible, and the occurrence of the pull out phenomenon can be reduced.

The embodiment of the present invention has been described as above, however, the present invention is not limited to the above embodiment, but various design changes can be made without departing from the present invention described in the claims.

As described above, according to the first aspect of the present invention, the occurrence of the pull out phenomenon can be reliably prevented.

According to the second aspect of the present invention, the transmission torque from the magnetic force can be increased and the response of the driven shaft side can be increased by setting the inertial mass on the driven shaft side to a small value. Accordingly, the occurrence of the pull out phenomenon can be more reliably prevented.

According to the third aspect of the present invention, the variations in revolution of the driving shaft can be suppressed as much as possible, thereby reducing the occurrence of the pull out phenomenon.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A magnetic driving pump for a vehicle internal combustion engine, comprising:

a driving shaft;

a driven shaft mounted coaxially with said driving shaft; and a pair of permanent magnets, said pair of permanent magnets being one of 4-pole and 2-pole permanent magnets where magnetic poles adjacent in a peripheral direction are different and are respectively fixed to said driving shaft and said driven shaft, respectively, and being magnetized to have alternate N poles and S poles 90 degrees or 180 degrees in phase in a peripheral direction around an axis of said drive shaft;

wherein each of said pair of permanent magnets is ring shaped, one of said permanent magnets being provided within an inner perimeter of a cup-shaped rotary member fixed to said drive shaft, and the other one of said permanent magnets is fixed to said driven shaft with at least a portion coaxially covered by said rotary member.

2. The magnetic driving pump according to claim 1, wherein said drive shaft is interlocked with a crankshaft of the engine, said drive shaft being a camshaft interlocked and connected with said crankshaft at a deceleration ratio of 1/2.

3. The magnetic driving pump according to claim 1, further comprising a pump housing, said driven shaft being mounted for rotation within said pump housing.

4. The magnetic driving pump according to claim 3, wherein said driven shaft includes an impeller mounted for rotation therewith.

5. The magnetic driving pump according to claim 1, wherein each of said pair of permanent magnets is a 2-pole permanent magnet.

6. The magnetic driving pump according to claim 1, wherein each of said pair of permanent magnets is a 4-pole permanent magnet.

7. A vehicle internal combustion engine, comprising:

an engine main body including a cylinder block and cylinder head;

a magnetic driving pump mounted on said cylinder head, said magnetic driving pump comprising:

a driving shaft;

a driven shaft mounted coaxially with said driving shaft; and a pair of permanent magnets, said pair of permanent magnets being one of 4-pole and 2-pole permanent magnets where magnetic poles adjacent in a peripheral direction are different and are respectively fixed to said driving shaft and said driven shaft, respectively, and being magnetized to have alternate N poles and S poles 90 degrees or 180 degrees in phase in a peripheral direction around an axis of said drive shaft;

wherein each of said pair of permanent magnets is ring shaped, one of said permanent magnets being provided within an inner perimeter of a cup-shaped rotary member fixed to said drive shaft, and the other one of said permanent magnets is fixed to said driven shaft with at least a portion coaxially covered by said rotary member.

8. The vehicle internal combustion engine according to claim 7, wherein said drive shaft is interlocked with a crankshaft mounted for rotation on said cylinder block, said drive shaft being a camshaft interlocked and connected with said crankshaft at a deceleration ratio of 1/2.

9. The vehicle internal combustion engine according to claim 7, said magnetic driving pump further comprising a pump housing, said driven shaft being mounted for rotation within said pump housing.

10. The vehicle internal combustion engine according to claim 9, wherein said driven shaft includes an impeller mounted for rotation therewith.

11. The vehicle internal combustion engine according to claim 7, wherein each of said pair of permanent magnets is a 2-pole permanent magnet.

12. The vehicle internal combustion engine according to claim 7, wherein each of said pair of permanent magnets is 4-pole permanent magnet.

* * * * *